US007901104B2

(12) United States Patent
McLean et al.

(10) Patent No.: US 7,901,104 B2
(45) Date of Patent: Mar. 8, 2011

(54) ILLUMINATED MOTORCYCLE HELMET SHELL

(76) Inventors: Maurice A. McLean, Lewisburg, TN (US); Stephon D. Brown, Gallatin, TN (US)

( * ) Notice: Subject to any disclaimer, the term of this patent is extended or adjusted under 35 U.S.C. 154(b) by 233 days.

(21) Appl. No.: 11/999,212

(22) Filed: Mar. 11, 2008

(65) Prior Publication Data

US 2009/0229040 A1 Sep. 17, 2009

(51) Int. Cl.
*F21V 21/084* (2006.01)

(52) U.S. Cl. ..... 362/106; 362/105; 362/183; 362/800

(58) Field of Classification Search ..... 362/103, 362/105, 106, 108, 183, 134, 800, 332, 464, 362/473, 540, 906, 249.06, 249.13, 234
See application file for complete search history.

(56) References Cited

U.S. PATENT DOCUMENTS 4,231,079 A * 10/1980 Heminover ..... 362/106
5,758,947 A * 6/1998 Glatt ..... 362/105
5,871,271 A * 2/1999 Chien ..... 362/106
6,302,558 B1 * 10/2001 Parks ..... 362/184
6,325,521 B1 * 12/2001 Gregg et al. ..... 362/106
6,328,454 B1 * 12/2001 Davis ..... 362/105
7,121,676 B1 * 10/2006 Kutnyak ..... 362/105
7,128,434 B1 * 10/2006 Nally et al. ..... 362/105
7,147,338 B2 * 12/2006 Gregg ..... 362/106
2002/0145865 A1 * 10/2002 Gregg ..... 362/106
2004/0052068 A1 * 3/2004 Chien et al. ..... 362/105
2006/0133068 A1 * 6/2006 Sherring ..... 362/105
2008/0080171 A1 * 4/2008 Lombard et al. ..... 362/106
2009/0303698 A1 * 12/2009 Huss et al. ..... 362/105
2010/0181940 A1 7/2010 Bucalo

* cited by examiner

*Primary Examiner* — Sandra L O Shea
*Assistant Examiner* — Danielle Allen
(74) *Attorney, Agent, or Firm* — Waddey & Patterson, P.C.; Matthew C. Cox

(57) ABSTRACT

A motorcycle safety helmet shell with one or more light emitting diodes molded or embedded therein. The motorcycle helmet shell is designed and arranged in a manner to provide visual recognition and/or identification of the wearer. The LED safety lighting system may be powered by a battery, or any other electrochemical device, i.e., dry cell or lithium-ion battery combination, mounted within or without the helmet shell; and may be manually and/or automatically activated. One or more lenses may cover one or more of the light emitting diodes.

18 Claims, 7 Drawing Sheets

ILLUMINATED MOTORCYCLE HELMET SHELL

FIELD OF INVENTIONS

This invention pertains to a lighting system to be molded into the shell of a safety helmet to facilitate the immediate recognition and/or identification of the wearer.

BACKGROUND OF THE INVENTION

Prior art include safety lights mounted of parts of a user's body, including head coverings such as U.S. Pat. No. 4,945,458. The device and object in this invention presents and illustrates a safety helmet containing a lighting device in its shell which lights up automatically or on command by pressing the on/off switch. A copper trace/lead trace board is attached that receives an electrical current from two 1.5 volt double A batteries found in the battery holder.

SUMMARY OF THE INVENTION

This invention provides a fire wire/LED (light emitting diodes) wherein an electrical current is sent throughout a copper trace/lead trace circuit board printed helmet shell from a nine volt pull tab battery holder that house two 1.5 volt double A batteries.

DETAILED DESCRIPTION OF THE INVENTION

Figure 1A:
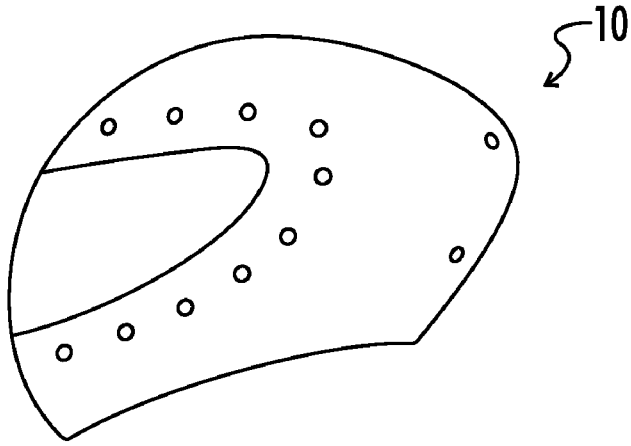
FIG. 1A—is an out perspective view of the helmet shell where LED light arrangements are embedded inside of the helmet shell.
Figure 1B:
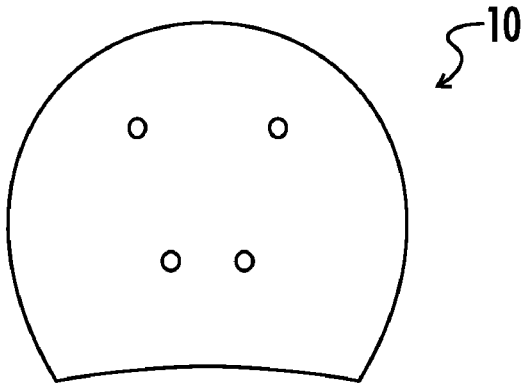
FIG. 1B—is an outer perspective view of the back of the helmet shell where LED lights are embedded.
Figure 1C:
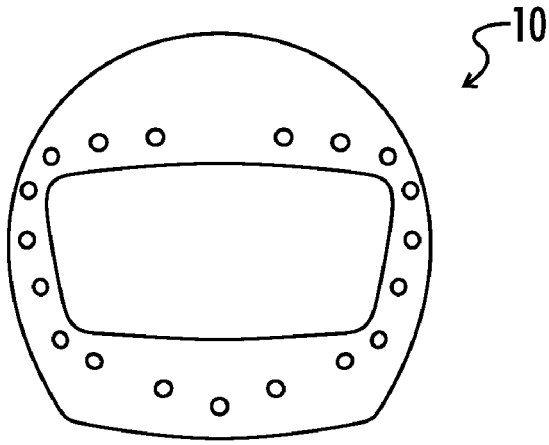
FIG. 1C—is an outer perspective view of the front of the helmet shell where LED lights are embedded inside of the helmet shell.
Figure 1D:
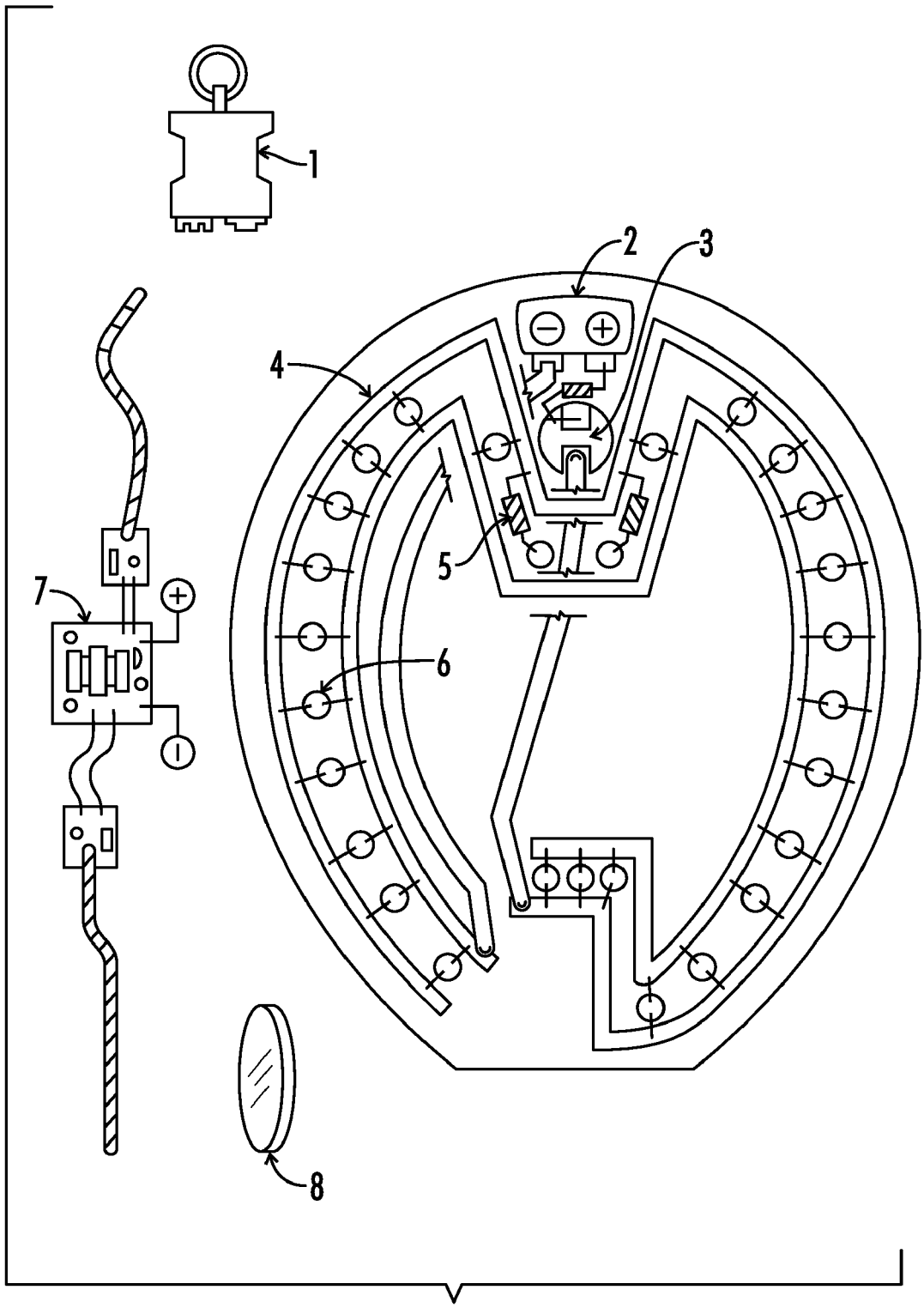
FIG. 1D—is an inside perspective view of the inner shell where electronic competence are molded inside of the helmet shell.

FIG. 1A shows an outer perspective view of a motorcycle helmet shell where the light emitting diodes 6 (LED) are embedded inside of the helmet shell. FIGS. 1B and 1C show these light emitting diodes 6 are systematically arranged around the upper facial part of the shell. In some embodiments, four light emitting diodes 6 are in the back of the shell and three light emitting diodes 6 are at the chin bar of the shell. FIG. 1D shows the inside perspective view of the inner components of the shell. In some embodiments a battery holder 1 engages a battery housing 2 on the motorcycle helmet shell. The battery holder's form is of a nine volt battery and, in one embodiment, has two 1.5 volt double A batteries in it and the battery holder 1 can be located in the battery housing 2 which is located at the middle/back area of the shell and near the bottom of the shell. The on/off switch 3 is molded at the back of the helmet and it is of the push button style. When the on/off switch 3 is pushed to the on position, then an electrical current protrudes to the copper trace/lead trace, or electrically conductive connector 4 which is then passed to the three resistors 5. The three resistors 5 are used as a protection for the batteries by not allowing a great amount of usage to be supplied by the batteries. The three resistors 5 are systematically arranged inside of the shell with one resistor 5 at the positive side of the battery housing. The negative side of the battery housing 2 is in the wall side of the copper trace which keeps the batteries from overloading and over heating the light system. The opposite end of the resistor 5 is hooked onto the power line of the switch 3. The other two resistors 5 are connected to the light emitting diodes 6 which enables the light emitting diodes 6 to produce light. The light emitting diodes 6 can be replaced by fire wires 7. In some embodiments, one or more lenses 8 cover one or more of the light emitting diodes 6. These lenses 8 are waterproof, located on the outside of the shell and will have various colors in some embodiments.

Figure 2A:
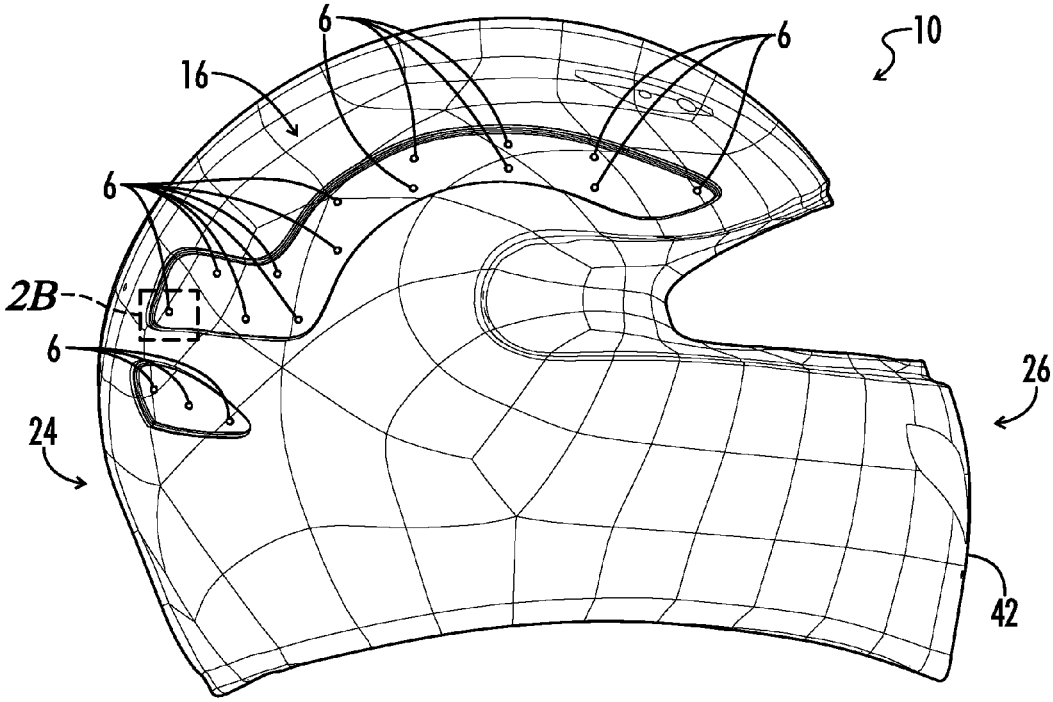
FIG. 2A illustrates an elevation view of one embodiment of a motorcycle helmet shell.
Figure 2B:
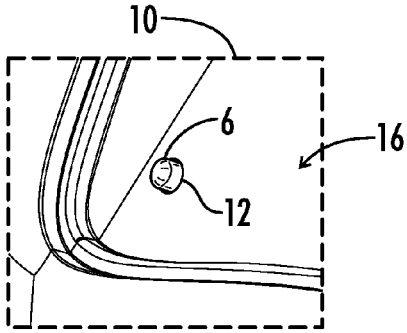
FIG. 2B illustrates a detail partial perspective view of one embodiment of a motorcycle helmet shell showing a light emitting diode.

Referring further to the drawings, FIG. 2A generally illustrates an embodiment of an illuminated motorcycle helmet shell 10. The motorcycle helmet shell 10 includes a front 26 and a back 24. The front 26 in one embodiment includes a chin bar 42. The motorcycle helmet shell 10 includes an exterior shell surface 16. In one embodiment, exterior shell surface 16 defines an exterior surface of a motorcycle helmet constructed using motorcycle helmet shell 10. The motorcycle helmet shell 10 in some embodiments includes one or more light emitting diodes 6 embedded in the motorcycle helmet shell 10. As seen in one embodiment illustrated in FIG. 2B, each light emitting diode 6 is embedded in a mounting hole 12 defined in the motorcycle helmet shell 10. Mounting hole 12 extends through motorcycle helmet shell 10. Each mounting hole 12 can be formed in one embodiment by drilling a hole in a motorcycle helmet shell 10 at each desired light emitting diode location. In another embodiment, each mounting hole 12 can be formed by molding the helmet shell 10 to include a mounting hole 12 at each desired light emitting diode location. In a further embodiment, each light emitting diode 6 is molded into motorcycle helmet shell 10.

Figure 3A:
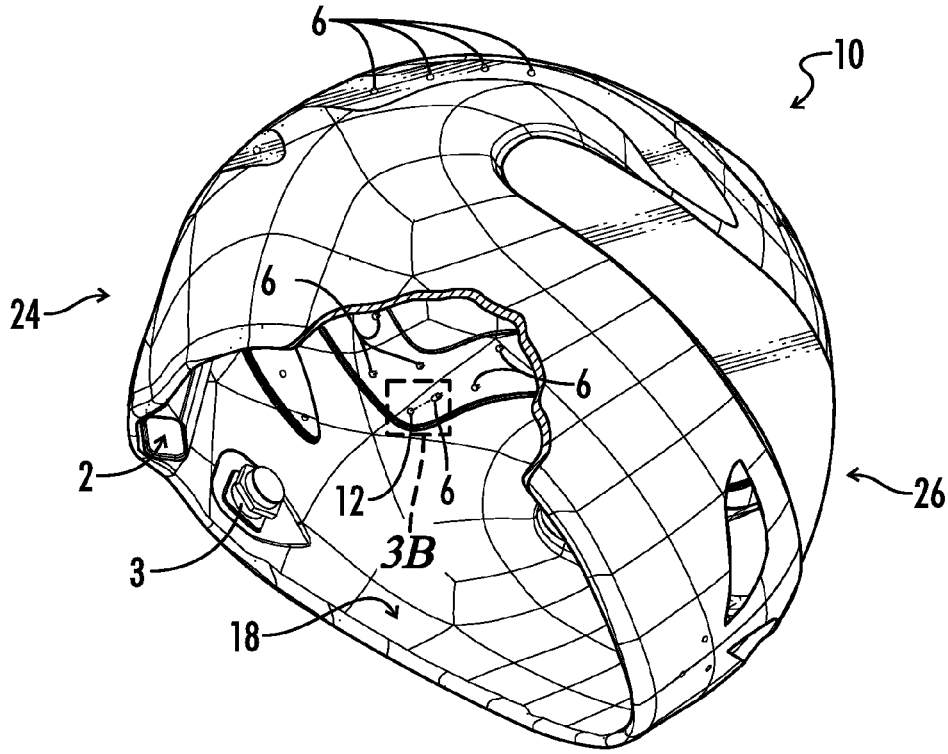
FIG. 3A illustrates a partially broken away view of one embodiment of a motorcycle helmet shell.
Figure 3B:
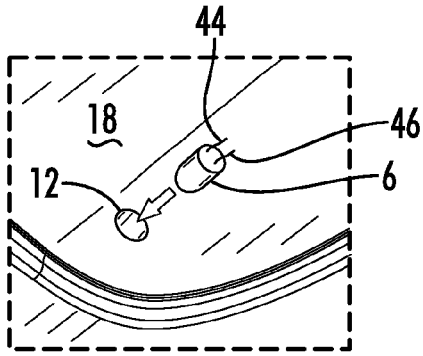
FIG. 3B illustrates a detail perspective view of one embodiment of a motorcycle helmet shell.

Referring now to FIG. 3A, the motorcycle helmet shell 10 includes a plurality of light emitting diodes 6 rigidly embedded directly into the helmet shell 10. In one embodiment, light emitting diode 6 can be rigidly embedded in shell 10 by securing light emitting diode 6 in place with an adhesive. Generally, one light emitting diode 6 is inserted through each hole 12 from the interior of the motorcycle helmet shell 10, as seen in FIG. 3A. Each light emitting diode 6 includes a positive terminal end 44 and a negative terminal end 46, seen in FIG. 2B. Each terminal end 44, 46 protrudes from light emitting diode 6 toward the interior of the motorcycle helmet shell 10 when light emitting diode 6 is inserted into mounting hole 12.

Also seen in FIG. 3A, in some embodiments, motorcycle helmet shell 10 includes a power supply housing, or battery housing 2 integrally formed in motorcycle helmet shell 10. Battery housing 2 in some embodiments is shaped to receive one or more battery holders 1, seen in FIG. 1D, for providing electrical power to each light emitting diode 6. Also seen in FIG. 3A, in one embodiment, an on/off switch 3 is disposed on the motorcycle helmet shell 10. In some embodiments, switch 3 and the power supply housing 2 are positioned nearer the back 24 of the motorcycle helmet shell 10. Switch 3 in some embodiments includes a push-button style mechanical switch. In other embodiments, switch 3 is a rocker switch.

Figure 4:
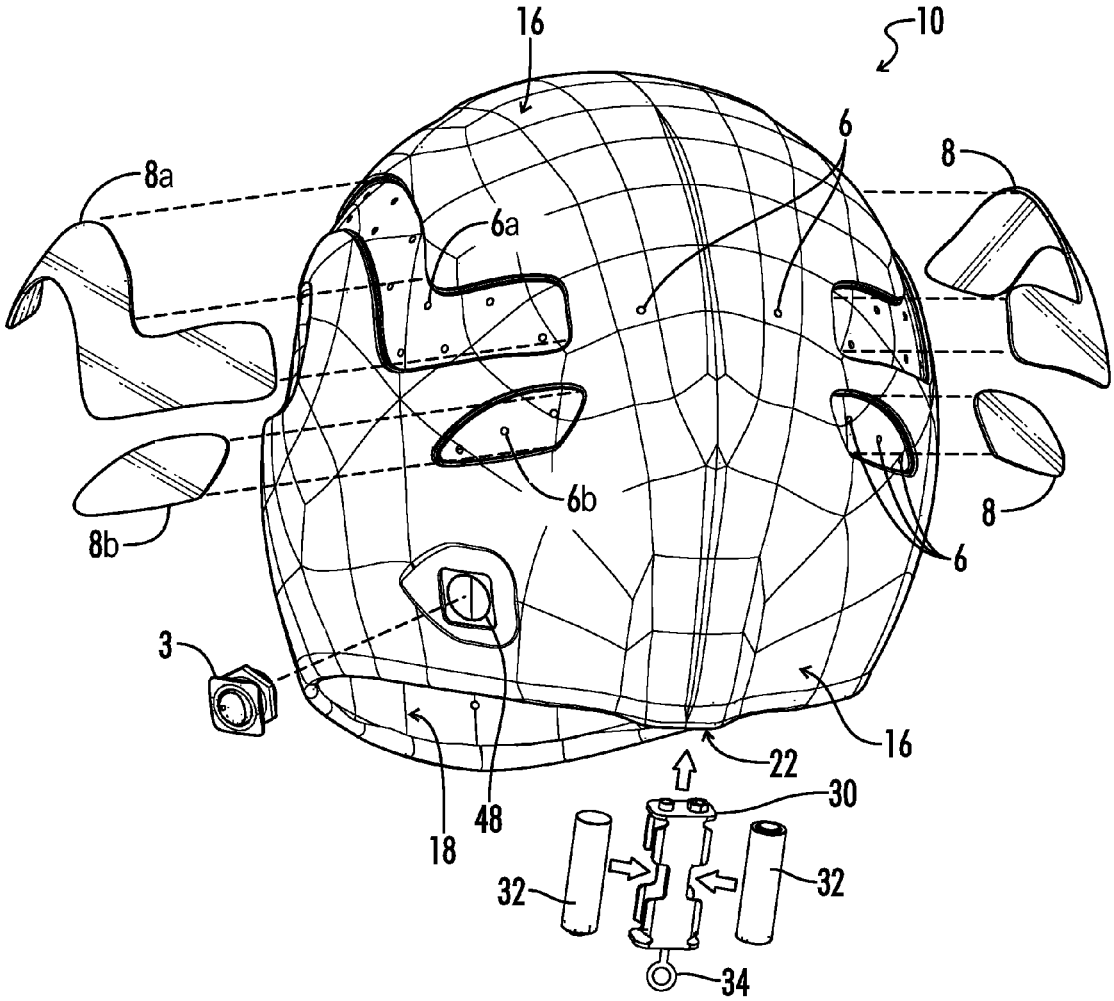
FIG. 4 illustrates a partially exploded view of one embodiment of a motorcycle helmet shell.

Referring now to FIG. 4, in one embodiment of a motorcycle helmet shell 10, a plurality of light emitting diodes 6 are embedded in motorcycle helmet shell 10. In some embodiments, one or more lenses 8 cover one or more light emitting diodes 6. Light generally passes from the light emitting diode 6 through the lens 8. In some embodiments, one or more lenses 8 are positioned on the exterior surface 16 of the motorcycle helmet shell 10, as seen in FIG. 4. A first lens 8*a* in some embodiments is disposed on the exterior surface 16 of motorcycle helmet shell 10 covering a first light emitting diode 6*a*. First lens 8*a* includes a first color. A second lens 8*b* is also disposed on the exterior surface 16 of the motorcycle helmet shell 10. Second lens 8*b* covers a second light emitting diode 6*b* embedded in motorcycle helmet shell 10. Second lens 8*b* includes a second color different than the first color. In some embodiments, each lens 36 provides a waterproof cover for one or more light emitting diodes 6.

Referring further to FIG. 4, a power supply located on the motorcycle helmet shell 10 in some embodiments includes a battery pack 30 configured to be inserted into battery housing 2. Battery pack 30 includes one or more batteries 32 and a pull tab 34 extending from battery pack 30. Pull tab 34 allows the user to manually remove the battery pack 30 from the battery housing 2. In one embodiment the battery pack 30 is configured to accommodate a nine volt battery. In yet other embodiments, battery pack 30 is configured to accommodate one or more 1.5 volt AA-type or AAA-type batteries, or various other battery types not shown.

Figure 5:
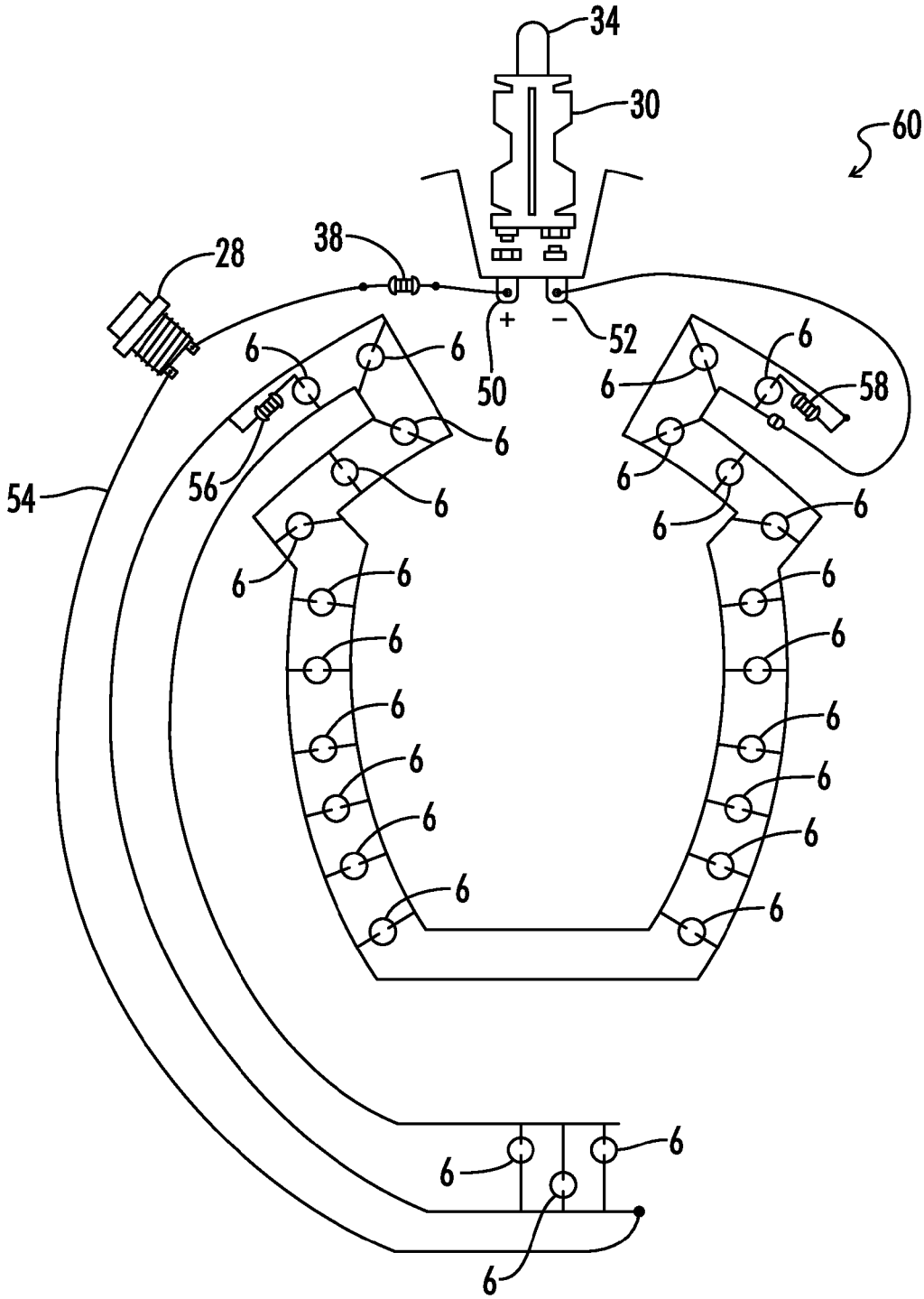
FIG. 5 illustrates a diagram of an embodiment of a wiring layout for one embodiment of a motorcycle helmet shell.

Referring now to FIG. 5, an embodiment of a wiring layout of a circuit 60 for powering light emitting diodes 6 embedded in motorcycle helmet shell 10 is generally illustrated. Battery pack 30 includes first terminal 50 and second terminal 52. In some embodiments first terminal 50 is a positive terminal and second terminal 52 is a negative terminal. In one embodiment, a first resistor 5 is connected in series between first terminal 50 and switch 3. A plurality of light emitting diodes 6 are electrically connected in parallel between switch 3 and second terminal 52. In one embodiment, each component including first resistor 38, switch 3 and light emitting diodes 6 are electrically connected by an electrically conductive connector positioned on the interior shell surface 18 of motorcycle helmet shell 10. In yet another embodiment, an electrically conductive connector, or conductive trace, is printed directly onto interior shell surface 18 of motorcycle helmet shell 10. Also seen in FIG. 5, in some embodiments, second and third resistors 56, 58 can be positioned between light emitting diodes 6 to control the power consumption of the light emitting diodes 6 and for increasing battery life. The first, second and third resistors 38, 56, 58 in some embodiments also prevent the circuit 60 from overheating.

The present disclosure also provides a method of manufacturing an illuminated motorcycle helmet. The method includes the steps of: (a) providing a plastic motorcycle helmet shell having an interior shell surface and an exterior shell surface; (b) forming at least one hole in the helmet shell; (c) inserting a light emitting diode into the mounting hole; and (d) electrically connecting the light emitting diode to a power supply positioned on the helmet. In some embodiments, the method includes the additional step of (e) electrically connecting a resistor in series between the power supply and the light emitting diode.

In some embodiments, a method of producing a motorcycle helmet shell includes a first step of removing the inner material of a motorcycle helmet to reveal just the helmet shell. Holes can be drilled in the helmet shell in a desired pattern. A light emitting diode is inserted into each hole. Glue, or adhesive, can be used as a sealer to secure the light emitting diode into the hole. In one embodiment, super glue, or crazy glue, works for this purpose. In this configuration, each light emitting diode includes positive and negative diode terminals. A first connector wire can be soldered to each positive diode terminal, and a second connector wire can be soldered to each negative diode terminal. In other embodiments, other types of electrical connections can be used to electrically connect each light emitting diode to the first and second connector wires. A switch mounting hole 48 can be drilled in the motorcycle helmet shell 10 for accommodating a switch 3, as seen in FIG. 4. In another embodiment, the switch 3 is molded on the motorcycle helmet shell 10. The switch can be secured in place using an adhesive. In some embodiments, the switch is electrically connected in series between the power supply and the first connector wire. In some embodiments, an internal layer can be positioned over the connector wires and electronic components on the interior surface of the motorcycle helmet shell. The internal layer in some embodiments includes tape.

Figure 6:
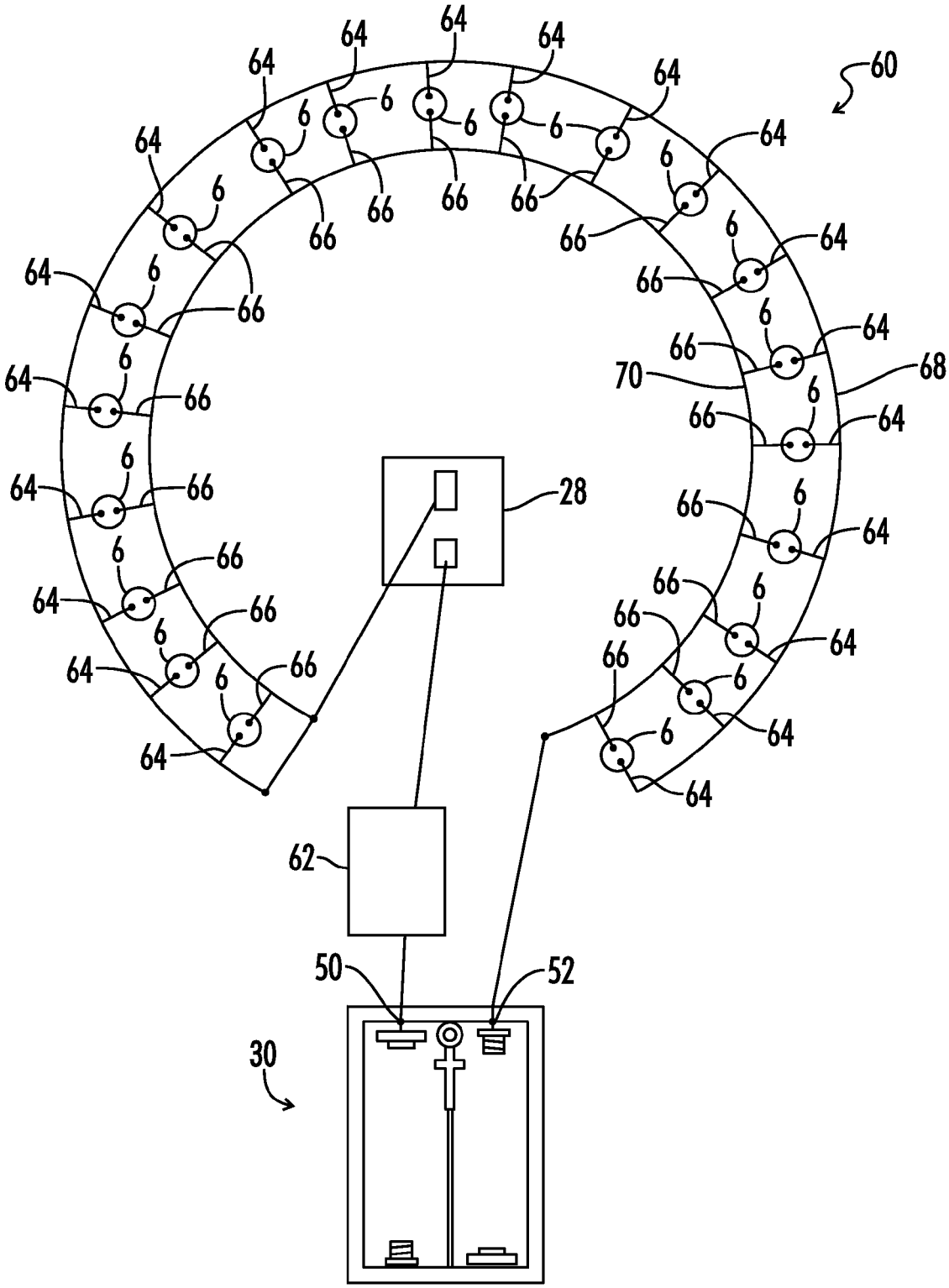
FIG. 6 illustrates a diagram of an embodiment of a wiring layout for one embodiment of a motorcycle helmet shell.

Referring now to FIG. 6, in one embodiment a motorcycle helmet shell includes a plurality of light emitting diodes 6 electrically connected in parallel to form a circuit 60. Each light emitting diode 6 includes a positive diode terminal 64 and a negative diode terminal 66. Each positive diode terminal 64 is generally aligned on the same side, and each negative diode terminal 66 is generally aligned on the opposite side. The positive diode terminals 64 of the light emitting diodes are electrically connected by a first connector wire 68, and the negative diode terminals 66 are electrically connected by a second connector wire 70. In one embodiment, seen in FIG. 6, a solar panel 62 is electrically connected to power supply 30. The solar panel 62 in one embodiment is disposed between switch 3 and power supply 30 for providing electrical power to light emitting diodes 6.

Thus, although there have been described particular embodiments of the present invention of a new and useful Illuminated Motorcycle Helmet Shell, it is not intended that such references be construed as limitations upon the scope of this invention except as set forth in the following claims.

It should be understood by all involved that some changes and variations can be made in the lighting system of this helmet-shell invention without voiding the scope of the original invention as defined by the claims.

What is claimed:

1. A motorcycle helmet shell apparatus for use on a motorcycle helmet, the apparatus comprising:

a motorcycle helmet shell having an interior shell surface and an exterior shell surface, the motorcycle helmet shell defining at least one mounting hole extending through the shell;

a first light emitting diode rigidly embedded in the mounting hole;

a power supply disposed on the motorcycle helmet shell, the power supply electrically connected to the first light emitting diode; and an electrically conductive connector disposed on the interior shell surface electrically connecting the power supply to the first light emitting diode.

2. The apparatus of claim 1, further comprising:
the power supply having first and second terminals;
the first light-emitting diode having first and second diode terminals; and
a first resistor electrically connected in series between the first terminal and the first diode terminal.

3. The apparatus of claim 2, further comprising:
a switch connected in series between the first terminal and the first diode terminal.

4. The apparatus of claim 1, further comprising:
a sealant disposed in the hole surrounding the light emitting diode.

5. The apparatus of claim 4, wherein the sealant comprises an adhesive.

6. The apparatus of claim 1, further comprising a first lens disposed on the exterior shell surface, wherein the first lens covers the first light emitting diode.

7. The apparatus of claim 6, wherein the first lens includes a first color.

8. The apparatus of claim 7, further comprising:
a second light emitting diode embedded in the motorcycle helmet shell; and
a second lens covering the second light emitting diode, wherein the second lens includes a second color different than the first color.

9. The apparatus of claim 6, wherein the first lens provides a waterproof cover for the first light emitting diode.

10. The apparatus of claim 1, wherein the power supply further comprises:
a battery housing formed in the helmet shell; and
a removable battery pack disposed in the battery housing, the battery pack including at least one battery for providing electrical power to the first light emitting diode.

11. The apparatus of claim 10, wherein the removable battery pack includes a pull tab extending from the battery pack for manually removing the battery pack from the battery housing.

12. The apparatus of claim 1, wherein the electrically conductive connector is printed directly onto the interior shell surface.

13. A motorcycle helmet shell apparatus comprising:
a motorcycle helmet shell having an interior shell surface and an exterior shell surface;
at least one mounting hole defined in the motorcycle helmet shell, the mounting hole extending from the interior shell surface to the exterior shell surface;
and
a light emitting diode rigidly embedded in the mounting hole.

14. The apparatus of claim 13, further comprising:
a power supply disposed on the motorcycle helmet shell, the power supply electrically connected to the light emitting diode; and
at least one resistor electrically connected in series between the power supply and the light emitting diode.

15. The apparatus of claim 14, further comprising:
a switch disposed on the motorcycle helmet shell, the switch operatively connected to the power supply for selectively providing electrical power to the light emitting diode; and
a resistor electrically connected in series between the power supply and the switch,
wherein the switch is connected in series between the power supply and the light emitting diode.

16. The apparatus of claim 13, further comprising a lens disposed on the exterior shell surface covering the light emitting diode.

17. A method of manufacturing an illuminated motorcycle helmet shell, the method comprising the steps of:
(a) providing a plastic motorcycle helmet shell having an interior shell surface and an exterior shell surface;
(b) forming at least one mounting hole in the motorcycle helmet shell;
(c) rigidly embedding a light emitting diode into the mounting hole; and
(d) electrically connecting the light emitting diode to a power supply positioned on the helmet.

18. The method of claim 17, further comprising the step of:
(e) electrically connecting a resistor in series between the power supply and the light emitting diode.

* * * * *

UNITED STATES PATENT AND TRADEMARK OFFICE

CERTIFICATE OF CORRECTION

PATENT NO. : 7,901,104 B2
APPLICATION NO. : 11/999212
DATED : March 8, 2011
INVENTOR(S) : Maurice A. McLean and Stephron D. Brown It is certified that error appears in the above-identified patent and that said Letters Patent is hereby corrected as shown below:

Title page
Item [75] should read
INVENTOR(S) Stephron D. Brown

Signed and Sealed this
Twenty-sixth Day of April, 2011

David J. Kappos

David J. Kappos
*Director of the United States Patent and Trademark Office*